US007088216B2

(12) United States Patent
Furuuchi

(10) Patent No.: US 7,088,216 B2
(45) Date of Patent: Aug. 8, 2006

(54) PROTECTIVE DEVICE

(75) Inventor: Yuji Furuuchi, Kanuma (JP)

(73) Assignees: Sony Chemicals Corp., Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 11/194,711

(22) Filed: Aug. 2, 2005

(65) Prior Publication Data

US 2005/0264394 A1 Dec. 1, 2005

Related U.S. Application Data

(63) Continuation of application No. PCT/JP04/000905, filed on Jan. 30, 2004.

(30) Foreign Application Priority Data

Feb. 5, 2003 (JP) ..... 2003-028541

(51) Int. Cl.
*H01H 85/165* (2006.01)
*H01H 85/48* (2006.01)

(52) U.S. Cl. ..... 337/183; 337/182; 337/297

(58) Field of Classification Search ..... 337/182, 337/183, 153, 297; 29/623; 439/890; 365/225.7
See application file for complete search history.

(56) References Cited

U.S. PATENT DOCUMENTS 4,494,104 A * 1/1985 Holmes ..... 337/403
5,097,247 A * 3/1992 Doerrwaechter ..... 337/405
5,712,610 A * 1/1998 Takeichi et al. ..... 337/290
6,300,859 B1 * 10/2001 Myong et al. ..... 337/182
6,373,371 B1 * 4/2002 Doerrwaechter et al. ... 337/297

FOREIGN PATENT DOCUMENTS

| | | |
|---|---|---|
| JP | A 1-117232 | 5/1989 |
| JP | U 6-60047 | 8/1994 |
| JP | A 8-161990 | 6/1996 |
| JP | A 10-116549 | 5/1998 |
| JP | A 10-116550 | 5/1998 |
| JP | B2 2790433 | 6/1998 |
| JP | A 11-111138 | 4/1999 |
| JP | A 11-353996 | 12/1999 |
| JP | A 2000-164092 | 6/2000 |
| JP | A 2001-118481 | 4/2001 |
| JP | A 2001-243867 | 9/2001 |
| JP | A 2004-71552 | 3/2004 |

* cited by examiner

*Primary Examiner*—Anatoly Vortman
(74) *Attorney, Agent, or Firm*—Oliff & Berridge PLC

(57) ABSTRACT

Protective devices for preventing overcurrent and overvoltage are disclosed. The devices includes a base substrate, a pair of electrodes formed on the base substrate, and a low-melting metal element connected between the pair of electrodes to interrupt the current flowing between the electrodes by fusion. An insulating cover plate is positioned and fixed in contact with the pair of electrodes serving as a spacer member.

5 Claims, 3 Drawing Sheets

PROTECTIVE DEVICE

This is a Continuation of International Application No. PCT/JP2004/000905 filed Jan. 30, 2004. The entire disclosure of the prior application is hereby incorporated by reference herein in its entirety

BACKGROUND

The present invention relates to protective devices that interrupt an electric current by fusing a low-melting metal element in the event of failure.

Protective devices comprising a heating element and a low-melting metal element stacked on a substrate have previously been known as protective devices that can be used to prevent not only overcurrent but also overvoltage (e.g., see Japanese Patent No. 2790433, JPA HEI 08-161990).

In the protective devices described in these patent documents, a current passes through the heating element in the event of failure so that the heating element generates heat to melt the low-melting metal element. The molten low-melting metal element is attracted onto the electrode on which the low-melting metal element is mounted on the electrode surface due to the good wettability, whereby the low-melting metal element is broken and the current is interrupted.

An alternative embodiment of connection between the low-melting metal element and the heating element in this type of protective device is also known from e.g. JPA HEI 10-116549 and JPA HEI 10-116550, according to which the low-melting metal element and the heating element are two-dimensionally arranged and connected to each other on the substrate rather than stacking the low-melting metal element on the heating element with the same result that the current supply to the heating element is interrupted upon fusion of the low melting metal element.

To meet the tendency toward size reduction of portable equipment, a means to reduce the thickness of this kind of protective device was proposed by providing a fuse (low-melting metal element) on a base substrate and sealing it with an insulating cover plate and a resin to reduce the thickness (e.g., see JPA HEI 11-111138).

Substrate-type temperature fuses according to this conventional technique comprise film electrodes formed on one side of a base substrate, a low-melting alloy piece bridged between the film electrodes, and a flux applied to the low-melting alloy piece. An outer insulating cover plate smaller than the base substrate is provided on one side of the base substrate, wherein a sealing resin is filled in a gap between the peripheral end of the insulating cover plate and the peripheral end of the base substrate, and the outer surface of the sealing resin between the peripheral end of the insulating cover plate and the peripheral end of the base substrate is a concavely curved sloped surface or a linearly sloped surface.

SUMMARY

However, such a sealing method by filling a resin around the insulating cover plate mounted on a flux as disclosed in the above conventional technique has the disadvantage that the thickness of the whole protective device is not uniform because it is difficult to control the thickness of the resin between the base substrate and the insulating cover plate.

In the method of the above-described conventional technique, the distance between the base substrate and the insulating cover plate depends on the amount of the flux or the pressing force of the insulating cover plate or the like and widely varies with coating unevenness of the flux or variation in the pressing force.

Thus, the thickness of the whole protective device cannot be assured and it is difficult to consistently meet demands for further reduction of the thickness of protective devices. This problem has become serious in the presence of demands for further reduction of size/thickness of such protective devices with the recent growing trend toward size/thickness reduction of electronic equipment.

The present invention addresses these problems with the art by providing a protective device having good dimensional stability without thickness variation in which the distance between the base substrate and the insulating cover plate can be reliably defined.

To solve the problems described above, the present invention provides a protective device for preventing overcurrent and overvoltage comprising a base substrate, a first and a second pair of electrodes formed on the base substrate, a low-melting metal element connected between the first pair of electrodes to interrupt the current flowing between the electrodes by fusion, a heating element connected between the second pair of electrodes wherein the heating element is positioned near the low-melting point metal element in parallel circuit to heat and cause the low-melting point metal element to fuse when the event of failure is occurred, spacer members provided in contact with the first and second pair of electrodes respectively, and an insulating cover plate opposed the base substrate on the side of the base substrate having the electrodes and fixed at an aligned position in contact with the spacer member.

In the present invention, the spacer member is preferably a lead connected to electrodes.

In the present invention, the lead preferably has a folded part with which the insulating cover plate is in contact.

In the present invention, the insulating cover plate preferably has a concave corresponding to the low-melting metal element where fusion is to take place.

In the present invention, the insulating cover plate is preferably curved to form a concave corresponding to the low-melting metal element where fusion is to take place.

The present invention provides a protective device for preventing overcurrent and overvoltage comprising a base substrate, a first and a second pair of electrodes formed on the base substrate, a low-melting metal element connected between the first pair of electrodes to interrupt the current flowing between the electrodes by fusion, a heating element connected between the second pair of electrodes wherein the heating element is positioned near the low-melting point metal element in parallel circuit to heat and cause the low-melting point metal element to fuse when the event of failure is occurred, and an insulating cover plate opposed to the base substrate on the side of the base substrate having the electrodes, wherein the insulating cover plate is fixed on the base substrate at an aligned position via a spacer member.

In the present invention, at least one projection is preferably formed as the spacer member.

In the present invention, at least one projection is preferably formed on the edge of the insulating cover plate and the insulating cover plate is in the form of a case.

In the present invention, at least one hole corresponding to the projection is preferably formed in the base substrate.

In the protective device of the present invention having the structure described above, the distance between the base substrate and the insulating cover plate can be reliably regulated by the thickness of the spacer member or the height of the spacer member because the insulating cover plate is positioned and fixed in relation to the base substrate by contacting the insulating cover plate with the spacer member (e.g. lead) provided on the side of the base substrate, or contacting the spacer member provided on the insulating cover plate itself with the base substrate.

According to the present invention, therefore, thickness reduction is achieved and dimensional stability is ensured because the distance between the base substrate and the insulating cover plate is uniform in contrast to conventional techniques in which the distance between the base substrate and the insulating cover plate depends on the amount of the flux or the pressing force of the insulating cover plate or the like.

BRIEF DESCRIPTION OF THE DRAWINGS

FIG. 5(*a*) shows an example in which pins are formed; and FIG. 5(*b*) shows an example in which the insulating cover plate is in the form of a case.

DETAILED DESCRIPTION OF EMBODIMENTS

The most preferred embodiment of protective devices according to the present invention are explained in detail below with reference to the accompanying drawings.

Figure 1:
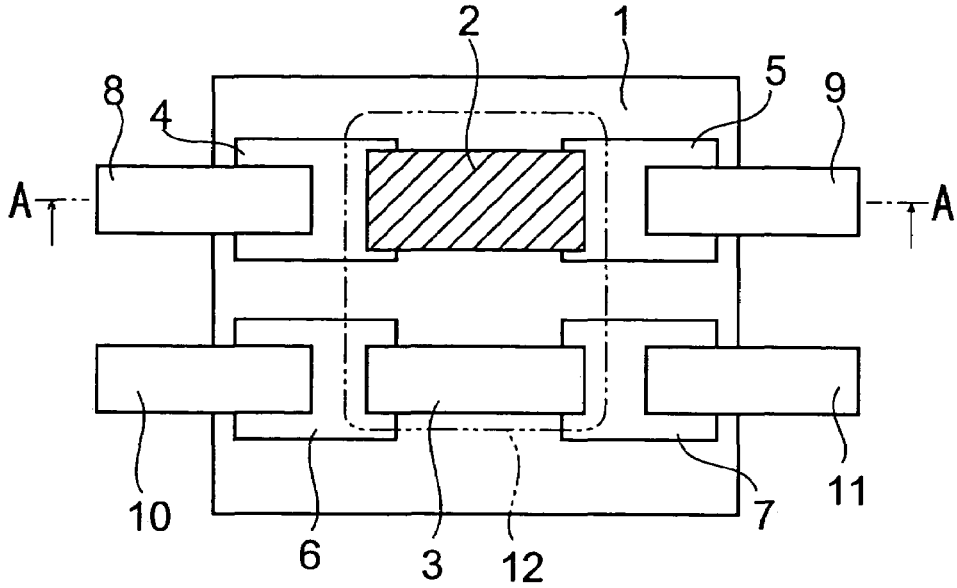
FIG. 1 is a plane view showing the inner structure of a protective device according to the present invention.

FIG. 1 shows an example of a protective device of the present invention (first embodiment). FIG. 1 is a plan view showing the state in which the insulating cover plate is removed. The protective device in this example is a so-called substrate-type protective device (substrate-type fuse), wherein a low-melting metal element 2 functioning as a fuse interrupting a current by fusion and a heating element (heater) 3, for melting the low-melting metal element 2 by generating heat in the event of failure, are arranged in proximity to and in parallel to each other on a base substrate 1 having a predetermined size.

A pair of electrodes 4, 5 for the low-melting metal element 2 and a pair of electrodes 6, 7 for the heating element 3 are formed on the surface of base substrate 1 and the low-melting metal element 2 and the heating element 3 are formed by, e.g., printing in such a manner that they are electrically connected respectively to electrodes 4, 5 or electrodes 6, 7. Leads 8, 9, 10, 11 are connected respectively to the electrodes 4, 5, 6, 7 to function as external terminals.

In the present invention, any insulative material can be used for the base substrate 1, including ceramic substrate, substrates used for printed wiring boards such as glass epoxy substrates , glass substrates, resin substrates, insulated metal substrates, etc. Among them, ceramic substrates are preferred because they are insulative substrates with high heat resistance and good heat conductivity.

For the materials of the low-melting metal element 2 functioning as a fuse, various low-melting metals conventionally used as fuse materials can be used such as, for example, the alloys described in Table 1 of JPA HEI 8-161990. Specifically, alloys include BiSnPb, BiPbSn, BiPb, BiSn, SnPb, SnAg, PbIn, ZnAl, InSn, and PbAgSn alloys. Low-melting metal element 2 may be in the form of a thin leaf or rod.

The heating element 3 can be formed by, for example, applying a resistance paste comprising a conductive material such as ruthenium oxide or carbon black and an inorganic binder such as water glass or an organic binder such as a thermosetting resin, and if desired, baking it. It can also be formed by printing, plating, depositing, or sputtering a thin film of ruthenium oxide, carbon black or the like, or applying, stacking or otherwise arranging these films.

The materials of the electrodes into which the molten low-melting metal element 2 flows, i.e., the electrodes 4, 5 for the low-melting metal element 2, are not limited and can be those having good wettability to the molten low-melting metal element 2. For example, they include elementary metals such as copper and electrode materials formed of Ag, Ag—Pt, Ag—Pd, Au or the like at least on the surfaces. For the electrodes 6, 7 relating to the heating element 3, there is no necessity to take into account the wettability for the molten low-melting metal element 2, but they are usually formed from similar materials to those for the electrodes 4, 5 for the low-melting metal element 2 because they are formed together with the electrodes 4, 5 for the low-melting metal element 2 described above.

The leads 8, 9, 10, 11 are formed of metal wire materials such as flattened wires or round wires and electrically connected respectively to the electrodes 4, 5, 6, 7 described above by soldering or welding or the like. When such an embodiment using leads is adopted, no attention need be paid to the installation side during the installation operation by symmetrically arranging the leads with respect to the electrodes 4, 5, 6, 7.

An inner seal 12 consisting of a flux or the like is provided on low-melting metal element 2 to cover low-melting metal element 2 in order to protect it from surface oxidation. In this case, any known fluxes with any viscosity can be used such as rosin system fluxes.

Figure 2A:
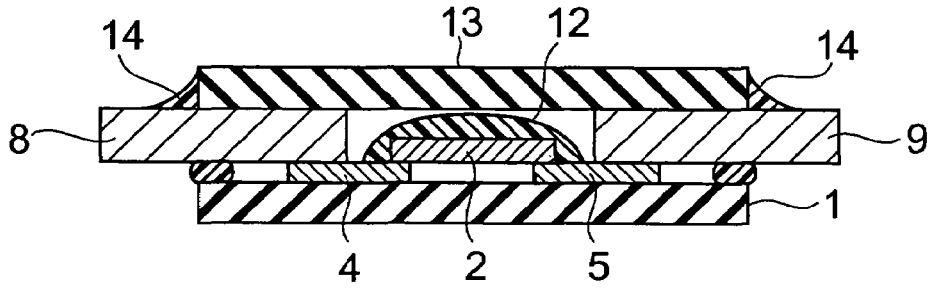
FIGS. 2(*a*) and (*b*) are schematic sectional views taken along A—A line of FIG. 1 showing that the insulating cover plate has been aligned and fixed.
Figure 2B:
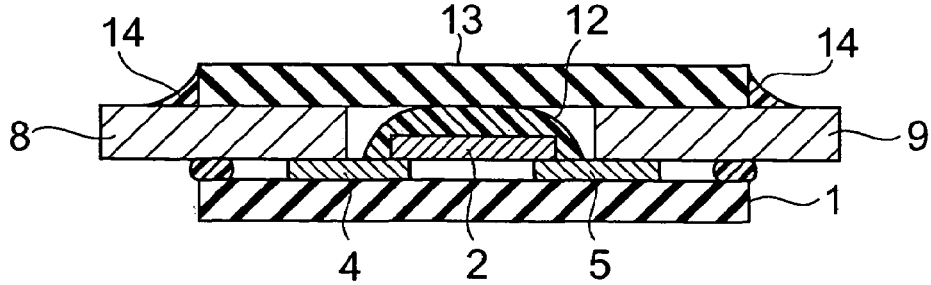

As shown in FIGS. 2(*a*) and (*b*), this inner seal 12 can be or not be in contact with the inner surface of insulating cover plate 13.

In the protective device according to the present embodiment having an inner structure as described above, the insulating cover plate 13 is provided to cover the low-melting metal element 2 and the heating element 3, as shown in FIGS. 2(*a*) and (*b*).

Such insulating cover plate 13 can inhibit the inner seal 12 from bulging or the like (see FIG. 2(*b*)) to achieve thickness reduction of the whole protective device. The insulating cover plate 13 can be made from any material having a heat resistance and a mechanical strength enough to withstand fusion of the low-melting metal element 2, including various materials used for printed wiring boards such as glass, ceramic, plastic, and glass epoxy substrates for example. Especially when a material having a high mechanical strength such as a ceramic plate is used, the thickness of insulating cover plate 13 itself can be reduced, which greatly contributes to the thickness reduction of the whole protective device.

Fuses having good response to external heat sources can be obtained by constructing insulating cover plate 13 from a highly heat-conductive material such as ceramic and contacting (thermally coupling) it with the side of the base substrate 1 via the inner seal 12 (flux) as shown in FIG. 2(*b*). In this case, the insulating cover plate 13 preferably has a similar size to that of base substrate 1 in terms of heat detection from both sides, but the present invention is not limited to such embodiments and similar effects can be obtained even if either one is smaller or larger.

Here, the insulating cover plate 13 is aligned and fixed at a predetermined distance from the base substrate 1 by placing a resin 14 around the cover plate 13 which is pressed into contact with the leads 8, 9, 10, 11, whereby the low-melting metal element 2 and the heating element 3 are cased in the space between insulating cover plate 13 and the base substrate 1.

That is, the insulating cover plate 13 is directly in contact with the leads 8, 9, 10, 11, and therefore, leads 8, 9, 10, 11 serve as spacer members for defining the distance between the base substrate 1 and the insulating cover plate 13 in the present embodiment.

Thus, the clearance (distance) between the base substrate 1 and the insulating cover plate 13 can be reliably regulated by the thickness of the leads 8, 9, 10, 11 by alignment and fixing the insulating cover plate 13 with respect to the base substrate 1 via contact with the leads 8, 9, 10, 11 which serve as spacer members on the base substrate 1.

According to the present embodiment, the leads 8, 9, 10, 11 have high rigidity because they are made of a metal, and therefore, thickness reduction is achieved and dimensional stability is ensured because the distance between base substrate 1 and insulating cover plate 13 is uniform in contrast to conventional techniques in which it depends on the amount of the flux or the pressing force of the insulating cover plate or the like.

Figure 3:
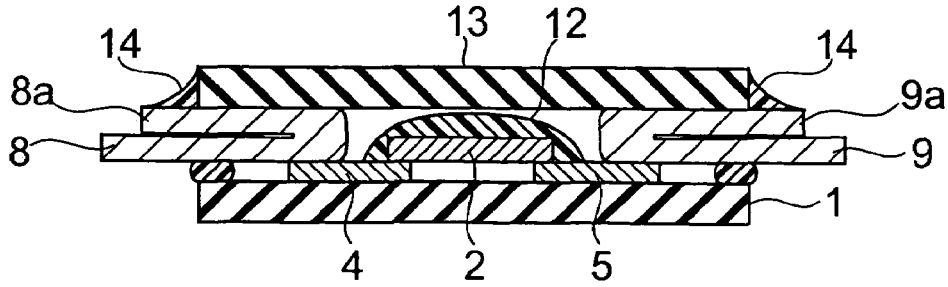
FIG. 3 is a schematic sectional view of a protective device using folded leads as spacers.
Figure 4A:
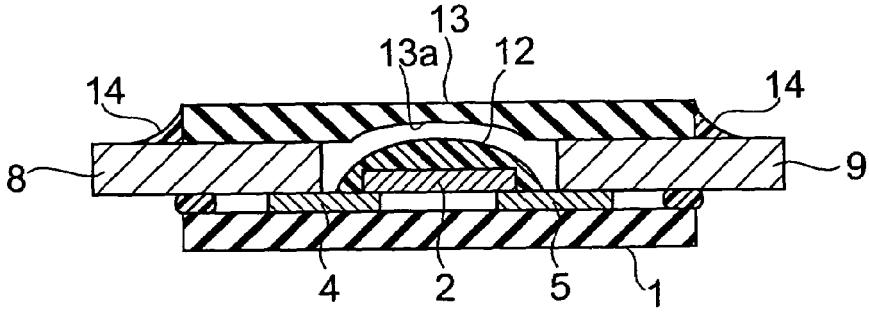
FIG. 4(*a*) is a schematic sectional view showing an example in which a concave is formed in the insulating cover plate, and FIG. 4(*b*) is a schematic sectional view showing an example in which part of the insulating cover plate is curved.
Figure 4B:
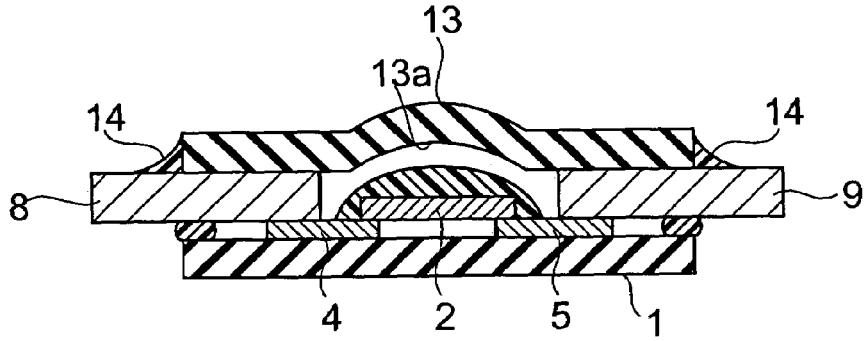

Although the foregoing embodiments are premised on the notion that the thickness of the leads 8, 9, 10, 11 is greater than the thickness of the low-melting metal element 2 or the heating element 3, the insulating cover plate 13 can also be fixed via contact with the folded part 8*a*, 9*a*, 10*a*, 11*a* formed by folding back the parts of the leads 8, 9, 10, 11 to permit contact with the insulating cover plate 13, as shown in FIG. 3, for example, in cases where the thickness of the leads 8, 9, 10, 11 is smaller than the thickness of the low-melting metal element 2 or the heating element 3. This embodiment is applicable even if the thickness of the low-melting metal element 2 or the heating element 3 is greater than the thickness of the leads 8, 9, 10, 11 because the distance between the insulating cover plate 13 and the base substrate 1 is enlarged to about twice the thickness of the leads 8, 9, 10, 11. In order to ensure a space for receiving the molten low-melting metal element 2, a concave 13*a* can be formed in the inner surface of the insulating cover plate 13 as shown in FIG. 4(*a*) or the insulating cover plate 13 itself can be curved to form the concave 13*a* corresponding to the fused part of low-melting metal element 2 as shown in FIG. 4(*b*). By making such changes, a space for receiving molten low-melting metal element 2 can be sufficiently ensured while keeping minimum thickness of the protective device.

In the case of the present invention, the spacer members are not limited to the leads 8, 9, 10, 11 as described above but may be other members. In this case, components packaged on the base substrate 11 of the protective device can be used as spacer members or a spacer member can be separately formed on the base substrate 1. When the leads 8, 9, 10, 11 are used, for example, the height thereof can be controlled by adjusting the thickness of the electrodes 4, 5, 6, 7 on which the leads 8, 9, 10, 11 are installed or by using a conductive adhesive or paste. However, attention should be paid not to use such a conductive adhesive or paste in excessively large thickness because it may cause variations.

Although all the protective devices described above relate to examples in which the spacer members for the insulating cover plate 13 are provided on the side of the base substrate 1, the present invention is not limited to such examples but a spacer member can be formed on the insulating cover plate 13 itself.

Figure 5A:
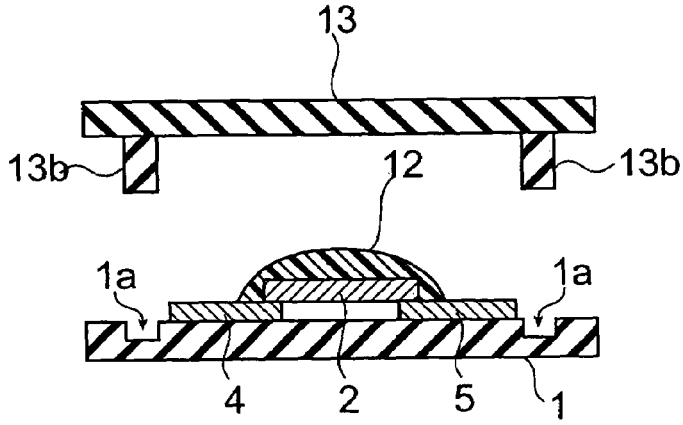
FIGS. 5(*a*) and (*b*) show examples in which a spacer member is formed on the side of the insulating cover plate.
Figure 5B:
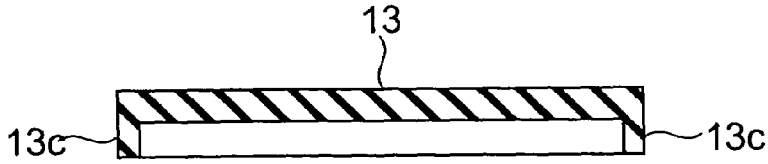

For example, the height position of the insulating cover plate 13 can be regulated by providing pins 13*b* at four corners of the insulating cover plate 13 as shown in FIG. 5(*a*) and contacting them with the base substrate 1. In this case, the pins 13*b* serve as spacer members. Dimensional stability and position stability are further improved by forming pin holes la at the parts of base substrate 1 that receive pins 13*b*, and inserting pins 13*b* into such pin holes 1*a*.

Ribs having a larger size than those of pins 13*b* can be formed and used as spacer members in place of the pins 13*b* described above. Alternatively, the insulating cover plate 13 can be in the form of a case (cap) by forming a wall 13*c* at the edge of the insulating cover plate 13 as shown in FIG. 5(*b*). In any case, the pins 13*b* or the wall 13*c* can be easily formed by injection molding or other means on the insulating cover plate 13.

Although embodiments in which the present invention is applied have been explained, it should be understood that the present invention is not limited to these embodiments but changes can be appropriately made without departing from the spirit of the present invention. Although the low-melting metal element 2 is broken by heating of the heating element 3 in the foregoing embodiments, the present invention can also be applied to self-melting protective devices without heating element, for example.

Specific examples in which the present invention is applied are explained below on the basis of experimental results.

EXAMPLE 1

Figure 6:
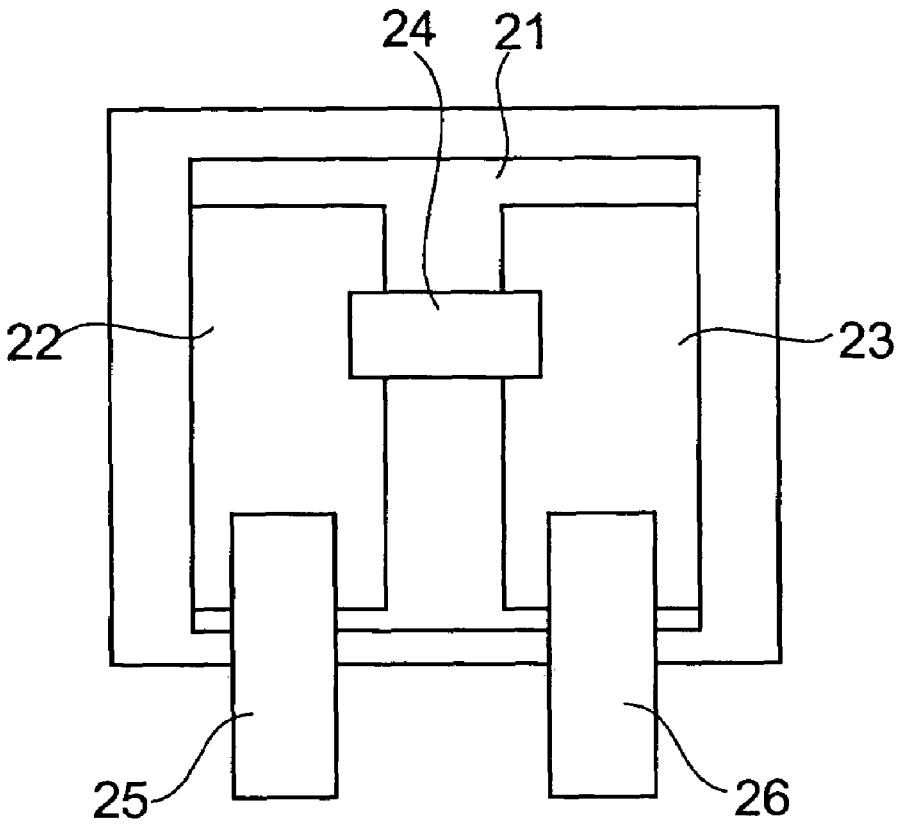
FIG. 6 is a schematic plane view showing the inner structure of the protective device prepared in the examples described below.

The present example is a case in which the present invention is applied to the self-melting protective device shown in FIG. 6. The structure of the protective device prepared comprises a pair of electrodes 22, 23 provided on a base substrate 21, and connected to each other via a low-melting metal element 24 and to leads 25, 26 connected individually to the electrodes 22, 23, respectively, as shown in FIG. 6.

Specifically, the electrodes 22, 23 are formed on the base substrate 21 consisting of a ceramic substrate having a dimension of 6 mm×6 mm and a thickness of 0.5 mm. Each electrode 22, 23 is consist of an Ag—Pd electrode formed by printing.

A low-melting metal (1 mm in width and 0.1 mm in thickness) is connected by welding between electrodes 22 and 23 and sealed with a rosin system flux (not shown). An Ni-plated Cu lead wire (1 mm in width and 0.5 mm in thickness) is connected to each electrode 22, 23 by soldering to form leads 25, 26.

Then a two-part epoxy resin was applied on the outer periphery of the base substrate 21 and a ceramic insulating cover plate (not shown) (dimension 6 mm×6 mm, 0.5 mm in thickness) was placed and pressed until it came into contact with the leads 25, 26 and the epoxy resin is cured under conditions of 40° C. for 8 hours.

EXAMPLE 2

The basic structure of the protective device is similar to that of the example above. In the present example, a weight was placed on the insulating cover plate during curing of the two-part epoxy resin to inhibit fluidity during curing.

Comparative Example

The basic structure of the protective device is similar to that of Example 1 above. However, a difference from Example 1 is that the insulating cover plate was not pressed until it came into contact with the leads.

Evaluation Results

The protective devices of the Examples and the Comparative example (each 10 devices) was prepared as described above and measured for average thickness and thickness range. The results are shown in Table 1.

TABLE 1

| | Average thickness (mm) | Thickness range (mm) |
|---|---|---|
| Example 1 | 1.30 | 1.25~1.40 |
| Example 2 | 1.28 | 1.25~1.35 |
| Comparative example | 1.55 | 1.4~1.8 |

It is shown from Table 1 above that the protective devices can be prepared with obviously reduced thickness and consistently with little variation by contacting the leads on the base substrate with the insulating cover plate.

According to the present invention, the distance between the base substrate and the insulating cover plate can be reliably defined and protective devices with excellent dimensional stability without thickness variation can be obtained while achieving thickness reduction because the insulating cover plate is fixed to the base substrate via a spacer member (e.g., lead) on the base substrate side in contact with the insulating cover plate, or a spacer member formed on the insulating cover plate itself in contact with the base substrate side.

What is claimed is:

1. A protective device for preventing overcurrent and overvoltage comprising:

a base substrate, a first and a second pair of electrodes formed on the base substrate, a low-melting metal element connected between the first pair of electrodes to interrupt the current flowing between the electrodes by fusion, a heating element connected between the second pair of electrodes, wherein the heating element is in thermal communication with the low-melting point metal element in parallel circuit to heat and cause the low-melting point metal element to fuse when the overcurrent or overvoltage occurs, spacer members provided in contact with the first and second pair of electrodes respectively, wherein the spacer members are leads connected respectively to the electrodes, and an insulating cover plate opposed to the base substrate on the side of the base substrate having the electrodes and fixed at an aligned position in direct contact with the spacer members.

2. The protective device of claim 1, wherein the leads have a folded part with which the insulating cover plate is in direct contact.

3. The protective device of claim 1, wherein the insulating cover plate has a concavity corresponding to at least one part of the low-melting metal element.

4. The protective device of claim 1, wherein at least one portion of the insulating cover plate is curved to form a concavity corresponding to at least one part of the low-melting metal element.

5. The protective device of claim 1, wherein the leads define a distance between the base substrate and the insulating cover plate.

* * * * *